US005417754A

United States Patent [19]

Hester

[11] Patent Number: 5,417,754

[45] Date of Patent: May 23, 1995

[54] COMPOSITION AND METHOD FOR SELECTIVE REMOVAL OF FABRIC DESIGN IMAGE

[76] Inventor: Michele L. Hester, 18220 Waldron Dr., Waldron, Mo. 64092

[21] Appl. No.: 171,816

[22] Filed: Dec. 22, 1993

[51] Int. Cl.[6] ..... D06Q 1/02

[52] U.S. Cl. ..... 106/203; 8/114.6; 8/115; 28/163; 252/8.6; 26/69 B

[58] Field of Search ..... 106/203; 8/114.6, 115; 28/163; 252/8.6; 26/69 B

[56] References Cited

U.S. PATENT DOCUMENTS 3,849,159 11/1974 Palmer et al. ..... 26/69 B
4,352,380 10/1982 Owen et al. ..... 8/114.6

OTHER PUBLICATIONS

Diserens (translation: Wengraf et al.), "The Chemical Technology of Dyeing and Printing", vol. II, Reinhold Publ. pp. 244–250 (1951).

Storey, "The Thames and Hudson Manual of Dyes and Fabrics", Thames and Hudson (publ), pp. 150–151, (1978) no month.

*Primary Examiner*—Mark L. Bell
*Assistant Examiner*—C. M. Bonner
*Attorney, Agent, or Firm*—Hovey, Williams, Timmons & Collins

[57] ABSTRACT

A composition for removing cellulose fibers includes an acidification agent such as aluminum sulfate and sodium bisulfate, a humectant such as glycerine, xanthan gum as a thickening agent, and water as the balance. The composition is mixed to a pseudoplastic state having substantial homogeneity, and may be applied to fabric according to a method of removing cellulose-containing fibers.

11 Claims, 1 Drawing Sheet

COMPOSITION AND METHOD FOR SELECTIVE REMOVAL OF FABRIC DESIGN IMAGE

BACKGROUND OF THE INVENTION

1. Field of the Invention

This invention relates to an improved aqueous composition that may be used to remove cellulose-containing fibers and the like from fabrics including cellulosic fibers such as cotton and rayon. More particularly, the composition has a substantially improved shelf life, and includes an acidification agent, an in optional humectant, water, and xanthan gum a substantially homogenous pseudoplastic mixture.

2. Description of the Prior Art

The Devoré or Brodier Chemeck fabric style results from a chemical process for producing the visual effect of machine embroidery. This process involves applying a "burn-out" solution to remove cellulose-containing fibers from fabric blends.

These fabric-removing compositions have previously employed sodium bisulfate or aluminum sulfate as an acidification agent serving to remove cellulose-containing fibers. The acidification agent is mixed with glycerine, and a polysaccharide thickening agent such as guar gum, and water.

These compositions are almost exclusively used in an industrial setting with practically no usage on the part of individual hobby and craft makers or small-scale commercial operations. The known compositions are usually mixed on-site as needed from bulk chemical stocks, and are promptly consumed because the storage or shelf life is typically less than two weeks and most commonly less than about one week. After that time, viscosity degrades to a point where the mixture appears thin and watery, and is no longer suitable for use due to compositional bleeding into the fabric surrounding the area sought to be removed, which results in poor design demarcation. The home hobbyist or small scale commercial operation typically cannot justify the expense of maintaining bulk chemical stocks, thus, the short shelf life precludes such entities from attempting Devoré style projects that may include art work and paper designs as well as wearable clothing.

SUMMARY OF THE INVENTION

Figure 2:
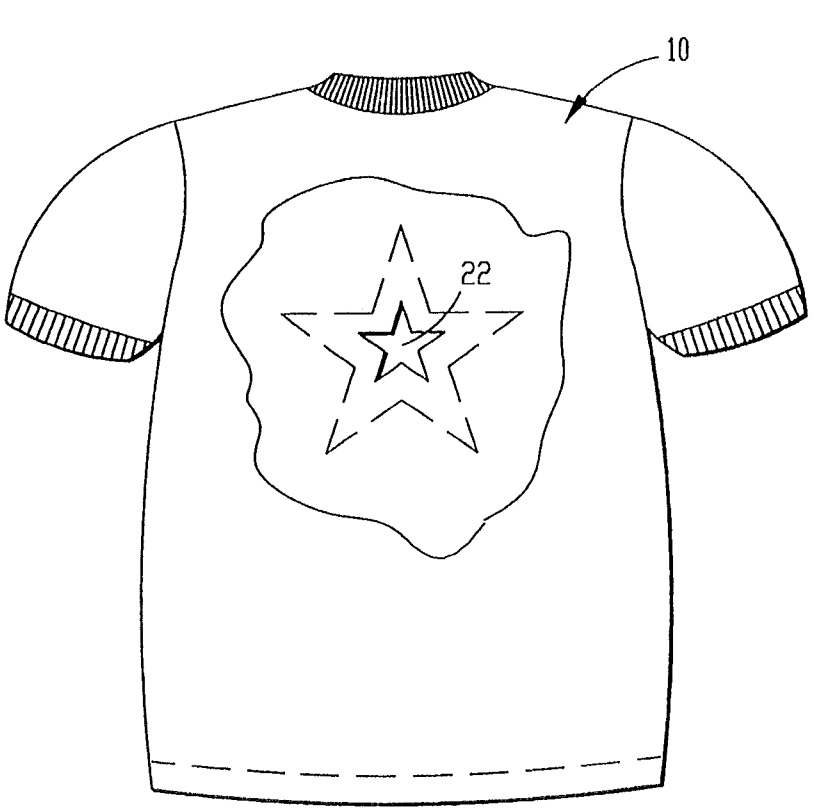
FIG. 2 is a rear view thereof with a broken rear portion exposing the interior side of the applique design applied to the front of the shirt.

The invention resolves the problems outlined above by providing a burn-out or fabric etching composition having a significantly improved shelf life. Additionally, the invention involves a method of using this composition, which does not require the on-site mixing of bulk chemicals and, consequently, makes the Devoré process available to individual craft makers and small-scale commercial operations.

The invention pertains to an improved fiber-removing composition utilizing xanthan gum as a preferred thickening agent. More particularly, the composition includes an acidification agent, water, and xanthan gum in a substantially homogeneous pseudoplastic mixture. A nonessential wetting agent or humectant may also be provided for the purpose of enhancing the contact of the composition with the fibers upon which it is to be deposited. The preferred composition has ingredients in amounts sufficient to provide a shelf life exceeding at least three months, which is a substantial shelf life improvement over prior cellulose removing compositions having non-xanthan polysaccharide thickening agents.

The acidification agent may be selected from the group consisting of aluminum sulfate and sodium bisulfate, with the acidification agent preferably being present in a proportion ranging between about 8% and 40%, more preferably between about 10% and 30%, and most preferably at about 15%–20%. The most preferred acidification agent is sodium bisulfate, due to the tendency of aluminum sulfate to stain fabric and enhance stringing in use.

The xanthan gum acts as a thickening agent, and is preferably present in an amount ranging between about 0.1% and about 3%;. Xanthan gum is more preferably present as a thickening agent in a proportion ranging between about 0.5% and 3%, and even more preferably between 0.8% and 2.5%, with the most preferred concentration being about 1.1% to 1.9%. The very most preferred thickening agent concentration is 1.5%.

The limiting factor in determining the upper and lower range limits of xanthan concentration is the viscosity of the composition. For example, 1% xanthan solutions typically have a viscosity of about 1000 centipoise (measured on an LV model Brookfield Sychro-Lectric Viscometer at 60 rpm, No. 3 spindle, at 25° C.). The viscosity of xanthan gum solutions may substantially hinder the room temperature mixing of compositions including gum proportions above 2%–3%. On the other hand, 0.5% xanthan compositions typically have a viscosity of about 300 centipoise, measured at 60 rpm as before, and 0.1% xanthan solutions may have a viscosity less than 100 centipoise. The lower viscosity compositions, and particularly those having a viscosity less than 100 centipoise, may produce an irregular line of removed fabric by bleeding into the fabric that is to be removed, and are much less preferred for working with detailed designs. Even so, these lower viscosity compositions remain useful for removing cellulose fibers and producing non-detailed designs.

Glycerine is preferably provided in a proportion ranging between about 1% and 15%, more preferably between 2% and 10%, and most preferably about 4%. Glycerine is an optional ingredient that may function as both a wetting agent and a humectant. As a wetting agent, glycerine enhances the integrity of the contact between the composition and the cellulose fibers to be removed. The humectant function of glycerine serves to retard the drying of the composition, which allows more time for the cellulose fibers to absorb the composition after it is applied to the fibers.

Water is be mixed with these ingredients as the balance for 100 weight percent, or other additives, such as Versatint (R) II (a purple polymer colorant from Milliken Chemical of 1440 Campton Road, Inman, S.C.), may be added as a fugitive coloring agent. This type of coloring agent will mark the area of cellulose fibers fabric being chemically removed without permanently staining the surrounding fabric at the periphery of the design.

The acidification agent of the composition is activated by heating, and also may react to accelerate a breakdown of the xanthan thickening agent during storage. Even so, the ingredients of the composition may be heated to a temperature ranging between about 100° F. and 200° F., in order to reduce viscosity for mixing purposes at the higher xanthan proportions approximating 2–3%.

The composition is utilized according to a method including the steps of applying the composition to a portion of the design to be removed, optionally allowing the composition to dry, and heating the composition for removal of the design portion of the fabric. The method may optionally include an additional step of sealing or sewing the edges of a design against unraveling.

DETAILED DESCRIPTION OF THE PREFERRED EMBODIMENT

EXAMPLE 1

A fabric-removing composition was prepared by mixing to substantial homogeneity the most preferred ingredients of the invention, including: sodium bisulfate in a 15% proportion by weight, 4% glycerine, 1.5% xanthan gum, 0.6% Versatint (R) ii, and 78.9% water. The xanthan gum was sifted with shearing action into the water at room temperature, and allowed to absorb water at room temperature for approximately two hours. The glycerins, sodium bisulfate, and coloring agent were then successively stirred into the xanthan gum and water mixture to form a substantially homogeneous pseudoplastic composition.

The term "substantially homogeneous pseudoplastic composition" applies because the initial mixture retained the pseudoplastic nature of xanthan solutions in that apparent viscosity decreased with shear rate; however, the composition had a wet surface appearance and included localized differences in consistency. Nevertheless, the high viscosity of the overall composition made it suitable for fabric-removing purposes because it did not bleed into the surrounding fabric and was capable of removing fabric along a well-defined line. The problems in composition consistency disappeared after a few hours of storage, as the xanthan gum more completely absorbed the water. Accordingly, while it is not necessary to do so, it is preferable to mix the xanthan gum and water prior to the addition of other ingredients, in order to allow proper water absorption over a period of time prior to acidification of the mixture, and to enable the mixing of the other ingredients into a relatively stable, viscous pseudoplastic base. The period of time for water absorption preferably exceeds about one hour, and most preferably exceeds two hours.

EXAMPLE 2

A comparative study was conducted by preparing a number of compositions having xanthan gum and other thickening agents substituted at various concentrations. The weight percentages of the compositional ingredients were varied to study the impact of different thickening agents and concentrations of ingredients upon the shelf life of the compositions.

The various mixtures were prepared with variations in the ingredients to form substantially homogeneous mixtures that were initially capable of being utilized for Devoré process fabric removal. The compositions including xanthan gum in a proportion greater than about 0.5% by weight were substantially pseudoplastic. The term "pseudoplastic" is here used in the sense that the xanthan thickened compositions formed a gel which liquified to a flowable state upon the application of pressure or agitation and subsequently returned to a gelled state upon removal of the external forces.

The respective mixtures were placed within sealed transparent containers on a shelf at room temperature and opened every few days to ascertain whether the viscosity of the mixture had degraded to a point where the respective mixtures were no longer useful for Devoré fabric etching or removal. The experiment was stopped for each sample when the sample appeared to be too watery or too thin for proper utilization according to the judgment of a person skilled in applying such compositions to cellulose-containing fabrics. The watery or thin nature of the degraded mixtures was presumed to result from the hydrolysis activity of the acidification agent upon the thickening agent over time. Table 1 summarizes the results.

TABLE 1

| (INGREDIENTS BY WEIGHT PERCENTAGES) | | | | |
|---|---|---|---|---|
| Thickening Agent* | Acidification Agent/Glycerine Percentages | Thickening Agent Percentage | Useful Days | Gel Strength Comments |
| Supergum 2210 | 20/5 | 5.9 | 7 | Watery |
| Supergum 2210 | 20/5 | 5.9 | 11 | Too thin |
| Supergum 2210 | 20/5 | 5.9 | 9 | Too thin |
| Supergum 2210/ Xanthan Gum | 20/5 | Supergum 2210 - 1.5 Xanthan Gum - 0.12 | 6 | Watery |
| Supergum 2210/ Xanthan Gum | 20/5 | Supergum 2210 - 4 Xanthan Gum - 0.4 | 7 | Too thin |
| Supergum 2255 | 20/5 | 3.0 | 1 | Too thin |
| Meyprogum NP-16 | 20/8 | 6.9 | 17 | Watery |
| Meyprogum NP-16 | 20/8 | 7.76 | 20 | Watery |
| Guar Gum | 20/8 | 1.65 | 19 | Watery |
| Indian Guar Gum | 15/4 | 0.72 | 7 | Watery |
| Indian Guar Gum | 15/4 | 1.2 | 7 | Watery |
| Guar Gum/ Xanthan Gum | 20/5 | Guar Gum - 1.33 Xanthan | 6 | Watery |

TABLE 1-continued (INGREDIENTS BY WEIGHT PERCENTAGES)

| Thickening Agent* | Acidification Agent/Glycerine Percentages | Thickening Agent Percentage | Useful Days | Gel Strength Comments |
|---|---|---|---|---|
| Guar Gum/ Xanthan Gum | 20/5 | Gum - 0.33 Guar Gum - 0.48 Xanthan Gum - 0.12 | 6 | Watery |
| Cabosil PTG/ Xanthan Gum | 15/4 | Cabosil PTG - 3.9 Xanthan Gum - 0.96 | >90 | No breakdown observed |
| Cabosil PTG/ Xanthan Gum | 15/4 | Cabosil PTG -2.9 Xanthan Gum - 0.87 | >90 | No breakdown observed |
| Xanthan Gum | 20/8 | 1.2 | >140 | No breakdown observed |
| Xanthan Gum | 20/5 | 0.9 | >110 | No breakdown observed |
| Xanthan Gum | 20/8 | 1.8 | >140 | No breakdown observed |
| Xanthan Gum | 15/4 | 1.5 | >85 | No breakdown observed |

*Supergum 2210 and Supergum 2255 are trademarks of Chemloid of Darien, Connecticut, and are described as "modified polysaccharide derivatives." Meyprogum NP-16 is a trademark of Meyhall, Inc. of Rhone Poulenc, Kreuzlingen, Switzerland, and is described as "Galactomannan." Cabosil PTG is a trademark of Cabot Corporation of Tuscola, Illinois, and is described as "amorphous fumed silica." Guar gum was purchased from Meer Corporation of Jersey City, New#Jersey. Indian guar gum was purchased from a supplier in Bombay, India. Xanthan gum was purchased from Gumix International of Fort Lee, New Jersey, and Meer Corporation of Jersey City, New Jersey.

Compositions having xanthan, either alone or as an ingredient in combination with amorphous fumed silica, as a proportion exceeding about 0.1% to about 0.5% significantly extend the shelf life to a period beyond 90 days. The preferred xanthan compositions significantly extended the shelf life, with a period exceeding nine to twelve months or longer being attainable under the preferred concentrations and conditions as determined by the retention of viscosity exceeding 100 cp at 25° . The exclusive use of xanthan gum or a combination of xanthan and amorphous fumed silica as a thickening agent is very much preferred, due to the relatively short shelf life of compositions having other polysaccharide based thickening agents.

EXAMPLE III

A comparative study was performed to ascertain the cellulose fiber removing capabilities of compositions having various aluminum sulfate and sodium bisulfate concentrations. Ten different compositions were prepared to include 1 g xanthan gum, 4 g glycerine, respective quantities of an acidification agent including aluminum sulfate or sodium bisulfate, and water as the balance of a total 100 g weight. The respective quantities of acidification agents were provided in compositions at successively increasing 5 g increments including quantities of 5 g, 10g, 15g, 20 g, and 25 g. In each case, the ingredients were individually mixed to homogeneity at room temperatures by utilizing a Singer 795 hand blender, and then allowed hydrate.

A control fabric was obtained by screen printing a composition including 1% xanthan, 4% glycerine, 15% sodium bisulfate, and 80% water, onto a one and one-eighth inch circular dot, and heating the fabric on a metal plate at about 345° t 350° F. until the design area turned a medium-brown color. This medium-brown color functioned as an indicator that the design area fabric was removable by brushing or water spraying actions. While the hot plate served to dry the wet compositions, the wet compositions could have been allowed to dry prior to heating.

The hydrated compositions were each screen printed onto a 50% polyester 50% cotton core wrapped cotton fabric, using a one and one-eighth inch diameter circular dot as the design image. A metal plate was heated to a temperature between about 345°–350° F., and the screened image fabric was placed on the heated plate. The fabric was retained on the plate until the screen printed area attained a medium-brown hue identical to the medium-brown hue of the design area of the control fabric. The time required to make this color change was measured as the time from the moment that the fabric was positioned on the heater plate until the color of the fabric visually matched the color of the control fabric. The results are presented in Table II.

TABLE II

COMPARISON OF ACIDIFICATION AGENTS

| Acidification Agent | Seconds To Control Color | Comments |
|---|---|---|
| 5 g sodium bisulfate | not achieved (>5 min.) | Not strong enough to completely remove fabric. |
| 5 g aluminum sulfate | not achieved (>5 min) | Not strong enough to completely remove fabric. |
| 10 g sodium bisulfate | 45.2 | Fabric removed acceptably. |
| 10 g aluminum sulfate | 37.0 | Fabric did not rinse cleanly due to aluminum sulfate residue. |
| 15 g sodium bisulfate | 19.1 | Fabric removed acceptably. |
| 15 g aluminum sulfate | 31.3 | Medium hard to screen due to stringing. |

TABLE II-continued

| COMPARISON OF ACIDIFICATION AGENTS | | |
|---|---|---|
| Acidification Agent | Seconds To Control Color | Comments |
| | | Cloth was back stained with difficult to remove aluminum sulfate residue. Fabric was removed. |
| 20 g sodium bisulfate | 15.6 | Fabric removed acceptably. |
| 20 g aluminum sulfate | 20.7 | Very difficult to screen due to stringing. Cloth was back stained with difficult to remove aluminum sulfate residue. Fabric was removed. |
| 25 g sodium bisulfate | 18.1 | Increased acid burned fabric very rapidly; too rapidly to catch and stop action. |
| 25 g aluminum sulfate | 21.9 | Increased acid burned fabric very rapidly; too rapidly to catch and stop action. Mixture almost too thick to screen print at all. |

EXAMPLE 4

A comparative study was performed to determine the optimal xanthan gum proportion in these compositions. Five compositions were mixed at room temperature according to the procedures previously described, to include 15.0 g sodium bisulfate, 4.0 g glycerine, xanthan proportion ranging between 0.5 and 2.5 g, and water as the balance of the composition to 100 g. The five compositions included xanthan proportions of 0.5 g, 1.0 g, 1.5 g, 2.0 g, and 2.5 g.

The compositions were allowed to hydrate for over two hours, and applied to cellulose fabric by screen printing procedures. The observations pertaining to their effectiveness are provided below in Table III.

TABLE III

| XANTHAN PROPORTION COMPARISON | |
|---|---|
| Xanthan Proportion (by weight) | Comments |
| 0.5% | Works well for applications having large body designs without detail work, but is unacceptably thin for fine-lined screen printing due to bleeding along the edge of the design. |
| 1.0% | Good results, with minor bleeding on fine-lined printing areas. |
| 1.5% | Great results. |
| 2.0% | Thickness hinders the ability to apply this composition evenly. |
| 2.5% | Thickness hinders the ability to apply this composition evenly. |

In another aspect of the invention, the preferred fabric removing compositions having an extended shelf life as described above may be utilized in a method for the selective removal of cellulose-containing fibers proximal to fabric design images.

Figure 1:
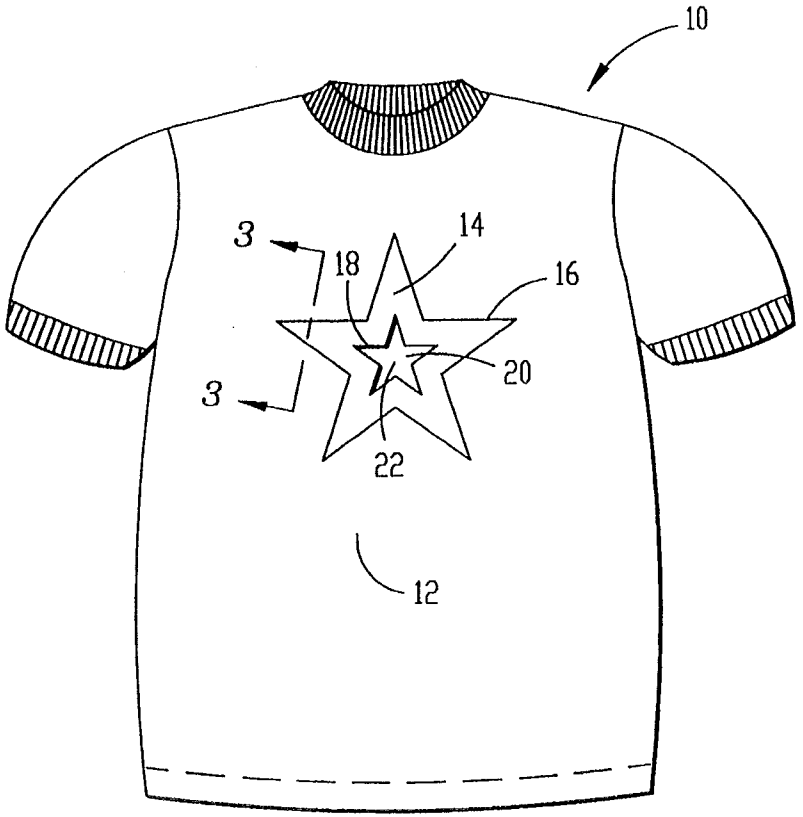
FIG. 1 is a front view of a t-shirt having a Devoré process design in the center torso portion.

Turning now to FIG. 1, t-shirt 10 includes a central front torso portion 12 having a star applique 14 at its center. Applique 14 presents an outer margin 16 and an interior margin 18 surrounding a central star-shaped aperture 20. Applique 14 is preferably formed of a resiliently flexible synthetic fiber or synthetic resin that does not contain cellulose or cellulose acetate. Aperture 20 is superimposed over a corresponding aperture 22 through the cellulose based fabric of shirt 10.

FIG. 2 depicts shirt 10 from a rear perspective having the back illustrated in a broken portion exposing the rear interior of applique 14, as well as aperture 22.

Figure 3:
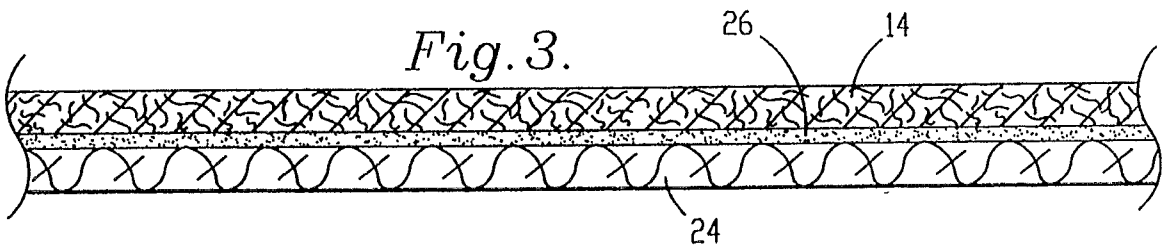
FIG. 3 is a broken cross-section taken along line 3'—3' of FIG. 1.

FIG. 3 depicts the exterior t-shirt material 24 connected by heat-sensitive mastic 26 to iron-on applique 14. The mastic becomes tacky upon heating of the applique by an iron, serving to hold the cellulose fabric edges defining aperture 22 against unravelling, as well as serving to hold applique 14 against fabric 24. Alternatively, the fabric edges that define aperture 22 may be sewn or painted to guard against unravelling without the addition of applique 14.

Aperture 22 is formed by applying a composition of the invention to fabric 24 over an exact outline of aperture 22 according to conventional screen printing techniques after ironing applique 14 to adhere it in position. The composition is allowed to dry, then an iron is placed on the "wool" setting or one of about 300° to 350° F., and placed over the dry area of aperture 22. The heat accelerates the action of the composition upon the dried fabric by increasing the activity of the acidification agent upon the cellulosic fibers to destroy intrafiber bonds. After heating, any remaining fibers in the area of aperture 22 may be removed by brushing, or pressurized water may be sprayed to remove substantially all residual traces of the composition.

Note that fabric 22 may be formed of a weave having both cellulose and non-cellulose based fibers, where application of the fabric removing composition of the invention to this type of fabric may result in the selective removal of cellulose fibers. This selective removal would allow the non-cellulose fibers to remain and form their own unique design which could extend over the area of aperture 22. By way of example, where the warp is primarily a cellulose fiber, and the weft is primarily a non-cellulose fiber, only the weft would remain.

Shirt 10 bearing applique 14 may be made according to a method including the steps of sealing or sewing the edges of a design area against unravelling, placing a preferred pseudoplastic fabric etching composition of the invention over at least a portion of the design for the removal of cellulose containing fibers, and rinsing off the excess composition after allowing the composition to remove cellulose fibers.

These previously described steps provide the advantage of making the process practical for home usage due to the extended shelf life of the composition. Accordingly, the method of using the invention also relates to a method of mixing the compound including mixing a batch composition in percentages of ingredients according to the invention, subdividing the batch composition into smaller portions each having an extended shelf life, and packaging the portions for distribution prior to use by the actual consumer. In contrast to the conventional Devoré process which only eliminated fibers from fiber blends, the method of the invention may also be utilized to completely remove areas of fabric for design purposes.

I claim:

1. An aqueous based composition for removing cellulose fibers from a fabric containing such fibers, said composition being formed of a mixture of ingredients comprising:

an acidification agent selected from the group consisting of sodium bisulfate and aluminum sulfate, said acidification agent being present in a proportion ranging from about 8% to 40% by weight;

water; and a thickening agent selected from the group consisting of xanthan gum and xanthan gum plus fumed silica, said thickening agent being present in a proportion ranging from about 0.1% to about 3% by weight, said ingredients forming a substantially homogeneous pseudoplastic mixture.

2. The composition as set forth in claim 1, including said ingredients present in amounts sufficient to provide a shelf life exceeding three months as determined by the retention of substantial viscosity suitable for removing cellulose fibers from said fabric containing such fibers.

3. The composition as set forth in claim 1, wherein is included the step of providing said ingredients in amounts sufficient to attain a shelf life exceeding nine months as determined by the retention of substantial viscosity in excess of 100 cp at 25° C.

4. The composition as set forth in claim 1, said acidification agent being sodium bisulfate.

5. The composition as set forth in claim 1, said xanthan gum and said xanthan gum plus fumed silica in each instance being present in a proportion ranging between about 1.1% and 1.8% by weight.

6. The composition as set forth in claim 5, said xanthan gum and said Xanthan gum plus fumed silica in each instance being present in a proportion of about 1.5% by weight.

7. The composition as set forth in claim 1, further including glycerine as an ingredient in a proportion ranging from about 1% to 15% by weight.

8. A method of preparing a cellulose fiber removing composition, comprising the steps of:

mixing xanthan gum in a proportion from about 0.5% to 3% by weight of the composition with water;

allowing said xanthan gum to absorb said water over a period of time to form a substantially pseudoplastic base; and thereafter combining said base with an acidification agent in a proportion ranging from about 8% to 40% by weight of the composition.

9. The method as set forth in claim 8, said period of time exceeding at least about one hour.

10. The method as set forth in claim 9, including the further step of combining said base and acidification agent with glycerine in a proportion ranging from about 1% to 15% of the weight of the composition.

11. A method for the selective removal of cellulose fibers from a fabric containing such fibers to produce a design image, said method comprising the steps of:

applying to a selected area of the fabric presenting said design, a quantity of a pseudoplastic mixture which includes an acidification agent selected from the group consisting of sodium bisulfate and aluminum sulfate, said acidification agent being present in a proportion ranging from about 8% to 40% by weight, a thickening agent selected from the group consisting of xanthan gum and xanthan gum plus fumed silica, said thickening agent being present in a proportion ranging from about 0.1% to about 3% by weight, and water;

allowing the quantity of said pseudoplastic mixture to remain in contact with said selected design area until the cellulose fibers contained in such fabric are substantially removed; and rinsing said fabric to remove remaining traces of said mixture.

* * * * *